US005934632A

United States Patent [19]

Weaver

[11] Patent Number: 5,934,632

[45] Date of Patent: Aug. 10, 1999

[54] UTILITY CAN HOLDER FOR USE WITH HOLLOW RUNG LADDER

[76] Inventor: Norman W. Weaver, 1014 Lookout Dr., Erie, Pa. 16507

[21] Appl. No.: 08/979,797

[22] Filed: Nov. 26, 1997

[51] Int. Cl.[6] ..... E06C 7/14

[52] U.S. Cl. ..... 248/210; 182/129

[58] Field of Search ..... 248/210, 211, 248/235, 311.2, 310, 312, 312.1, 315, 222.12, 231.7; 182/129, 120

[56] References Cited

U.S. PATENT DOCUMENTS

| | | | |
|---|---|---|---|
| 3,160,383 | 12/1964 | Lamn | 248/211 |
| 3,223,369 | 12/1965 | Benninger, Jr. | 248/210 |
| 3,420,486 | 1/1969 | Baker | 248/210 |
| 3,857,537 | 12/1974 | Swalinkavich, Jr. | 248/210 |
| 3,987,993 | 10/1976 | Hopkins | 248/210 |
| 4,099,693 | 7/1978 | Blann | 248/210 |
| 4,186,903 | 2/1980 | Fazakerley | 248/210 |
| 4,445,659 | 5/1984 | LaChance | 248/210 |
| 4,489,911 | 12/1984 | Riley | 248/238 |
| 4,523,733 | 6/1985 | Lunden, Jr. | 248/210 |
| 4,577,820 | 3/1986 | Michaud | 248/211 |
| 4,660,794 | 4/1987 | Given | 248/238 |
| 4,702,446 | 10/1987 | Brown | 248/210 |
| 4,824,060 | 4/1989 | Korda | 248/210 |
| 4,913,394 | 4/1990 | Schmid | 248/238 |
| 5,031,723 | 7/1991 | Hooten | 182/129 |
| 5,135,193 | 8/1992 | Parris | 248/238 |
| 5,145,226 | 9/1992 | Lafontaine | 294/27.1 |
| 5,181,682 | 1/1993 | Indelicato | 248/210 |
| 5,293,957 | 3/1994 | Lunden, Jr. | 182/129 |
| 5,649,682 | 7/1997 | Martin | 248/210 |

*Primary Examiner*—Leslie A. Braun
*Assistant Examiner*—Tan Le
*Attorney, Agent, or Firm*—Quinn, Buseck, Leemhuis, Toohey Kroto, Inc.; Kenneth W. Wargo

[57] ABSTRACT

A utility can holder for use with hollow rung ladders. The device includes an annular support member defining a recess into which a can, typically a standard one gallon paint can, or other container can be placed. The can is secured and prevented from falling through the recess by engagement means, such as a shelf surface upon which knobs of the can or a continuous protruding lip will rest. Attached to the annular support member is a rung insert member, comprising a smooth or ribbed tube which can be inserted through the hollow rung in a snug but rotatable fit, allowing the can to self-level by operation of gravity. A locking mechanism comprised of flexible tabs which spring open after the device has been inserted through the rung prevents accidental withdrawal of the device.

8 Claims, 8 Drawing Sheets

UTILITY CAN HOLDER FOR USE WITH HOLLOW RUNG LADDER

BACKGROUND OF THE INVENTION a. Field of the Invention

This invention relates to a simple, one-piece holder for use with hollow rung ladders. The primary use of the invention will be to hold a can of paint while the ladder is being used by a painter, but the invention may also be used as a holder for tools or other items.

b. Description of the Prior Art

Generally speaking, ladders are of two types. Folding step ladders, usually of modest size, have two hinged members which fold out into a free-standing ladder which does not need to be leaned against anything to be used. Most folding step ladders also have a shelf that folds down when the ladder is opened up, providing a convenient place to put a paint can or other items, or the top step can be used as a shelf. The other type of ladder which is commonly available is used by leaning it against a surface, typically the outside of a building. This type of ladder essentially consists of a pair of rails separated by regularly-spaced rungs. When two of these units are connected together in such a manner that they can be slidably disposed to each other and locked into place at a desired position, the result is an extension ladder which can reach to great heights and which is very useful for such things as painting the outside of a building.

Leaning ladders have always presented a problem with respect to finding a suitable and convenient way to secure a paint can or other item while the ladder is in use. Unlike the folding step ladders, the leaning ladders do not have a shelf for this purpose, and their rungs are typically narrow and not suitable for use as a surface to place things. Since leaning ladders are frequently used by painters who require immediate access to a paint supply to perform their job efficiently, there has been a longstanding need to provide some means to accomplish that purpose. The traditional solution has been to simply hang a can of paint from one of the ladder rungs by use of a wire twisted into an S-shape, with one end hooked around a rung and the other end around the handle of the paint can. While this method works, as attested to by the fact that the Applicant has observed numerous painters employing just this method right up to the present, it leaves much to be desired. For one thing, it is awkward and potentially dangerous. The paint can hangs behind the ladder, so that the painter must either reach around the ladder with some loss of balance or through the rungs to get access to the paint can. This slows down the painting process and can lead to sloppiness and unwanted paint spillage as the brush is repeatedly transferred back and forth from the paint can to the work surface in this awkward manner. The handle of the pain can also tends to get unwanted paint on it. Also, when a paint can, particularly one nearly full, is suspended by this method, there is a tendency for the can to swing around as paint is retrieved from the can, and if too much pressure is placed on the can during this process, the handle on the paint can will slide within the hanging wire, resulting in a paint can which is not level.

It is therefore apparent that there is a need for a better way to secure paint cans for use by painters on leaning ladders. Ideally, the solution should be a holder which is simple, inexpensive, durable and reliable. Applicant's invention meets all of these requirements. Applicant's invention relies upon the nature of the construction of modern leaning ladders. In particular, the vast majority of the ladders now in use and being sold are made of aluminum and have hollow rungs. In fact, according to Applicant's best information, a single company, R.D. Werner and Company, manufactures about 80% of these ladders which are made in the United States, and the Werner ladders have a uniform width between the ladder rails, and a uniform diameter of the hollow rungs. In considering these facts in relation to the problem identified above, Applicant conceived of the idea of using the hollow rung of the ladders as part of the solution in a manner which will be described further below.

The prior art discloses a recognition that the hollow rungs of a ladder can be used as a solution to the problem of conveniently holding a paint can when the ladder is in use. However, to Applicant's best knowledge, none of the prior patents along these lines have achieved any noteworthy commercial success. Discussions with professional painters and inquiries with painting supply stores have indicated a lack of awareness that devices which utilize the hollow rungs of the ladder are available.

Several examples of holders for hollow-rung ladders can be cited. For example, U.S. Pat. No. 4,523,733 by Lunden, Jr. discloses a rigid tube with a suspended shelf on one of its ends. When the opposite end of the tube is inserted into the hollow rung of a ladder, the rigid tube is thereby supported, which in turns supports the suspended shelf on which a paint can is placed.

U.S. Pat. No. 4,702,446 by Brown describes a "ladder caddy" which again uses a rigid tubing member to be inserted into a hollow ladder rung. Rather than a shelf surface, however, Brown discloses a snap-lock holding band. The paint can is placed within the band, which is then snapped closed, tightening around the can. The band itself is attached to the rigid tube through various wooden parts, such that the band, and paint can held therein, hang below the rigid tube which has been inserted into the hollow ladder rung.

Yet another invention along these lines is U.S. Pat. No. 4,824,060 to Korda. This invention discloses a rod which is long enough to extend completely through a hollow ladder rung. One end of the rod is threaded, thereby allowing a paint can holder to be secured by a wing nut to the rod. The opposing end of the rod has a pivoting latch plate which by gravity drops down to a vertical position once the rod has been inserted completely through the hollow ladder rung, thus supposedly securing the rod in place in the rung. The paint can holder portion of Korda's invention is simply a U-shaped frame with a cylindrical top piece conforming to the diameter of the paint can. The paint can rests on the U-shaped frame and is held in place by the cylindrical top piece.

U.S. Pat. No. 5,316,251, to McGraw discloses a paint can holder for hollow-rung ladders which is self-leveling in two planes. McGraw uses a rigid tube to be inserted into the hollow ladder rung and an elliptically-shaped frame member which is attached to the tube. The paint can is supported by a pair of notches in the frame member which are sized and spaced to receive the handle bosses found on a standard size paint can. Since the rigid tube inserted into the ladder rung is cylindrical, McGraw's device is rotatable about the axis of the rung, and self-leveling as the angle of the ladder against the building is changed. Also, because the handle bosses are round and can be rotated within the notches of the elliptical frame member, the paint can is self-leveling in a second direction. McGraw discloses embodiments of his invention in which the rigid tube member extends only partway through the hollow rung to secure one can of paint, and another embodiment in which two cans of paint, one can on each side of the ladder, can be secured by threading together two tubing members with an elliptical frame member on each side.

In U.S. Pat. No. 5,293,957, Lunden, Jr. discloses a device in which one piece of steel rod which has been formed into a circle is welded to the open end of another piece of rod bent into an elongated U-shape. The closed end of the U-shaped piece is offset and has a sleeve placed over it. When the U-shaped piece is inserted into a hollow ladder rung, and a container placed into the ring, the weight of the container pivots the offset end of the U-shaped piece into contact with the upper inside surface of the rung, thereby securing the holder in place.

Finally, U.S. Pat. No. 5,649,682, to Martin discloses a flat strip of metal of a size suitable to fit inside the hollow ladder rung. One end of the strip is bent into an open-ended ring shape, with an overlap which allows a paint can to be placed within the ring which can then be tightened around the can by fastener means, for example a wing nut.

As the above indicates, there has been a good deal of effort in this area, but at least from applicant's perspective, little notable success commercially or in the field. This can be attributable to disadvantages inherent in the prior art, including over-complexity and inconvenience to use. Applicant also believes there may be a problem with perception, with painters being resistant to using any device which does not give the clear appearance of being able to securely hold a can of paint without the danger that the holder can come loose, spilling the contents of the paint can below, with potentially disastrous results.

Accordingly, there are a number objects of the present invention. It is an object of the present invention to provide a simple and reliable utility holder for use with a hollow rung ladder. It is a further object of the present invention to provide such a holder as a single piece. It is a further object of this invention to provide a holder which can be positively locked into place so that there is no possibility it can inadvertently become loosened or dislodged from the ladder. It is yet another object of this invention to provide for a holder which is rotatable within the hollow rung of the ladder so that when the holder is used to hold a paint can it will self-level as the angle of the ladder is changed. Finally, it is an object of the present invention to disclose a paint can holder which can be manufactured from molded plastic, resulting in a combination of extreme durability and economical cost of production.

DESCRIPTION OF THE PREFERRED EMBODIMENT

Figure 1:
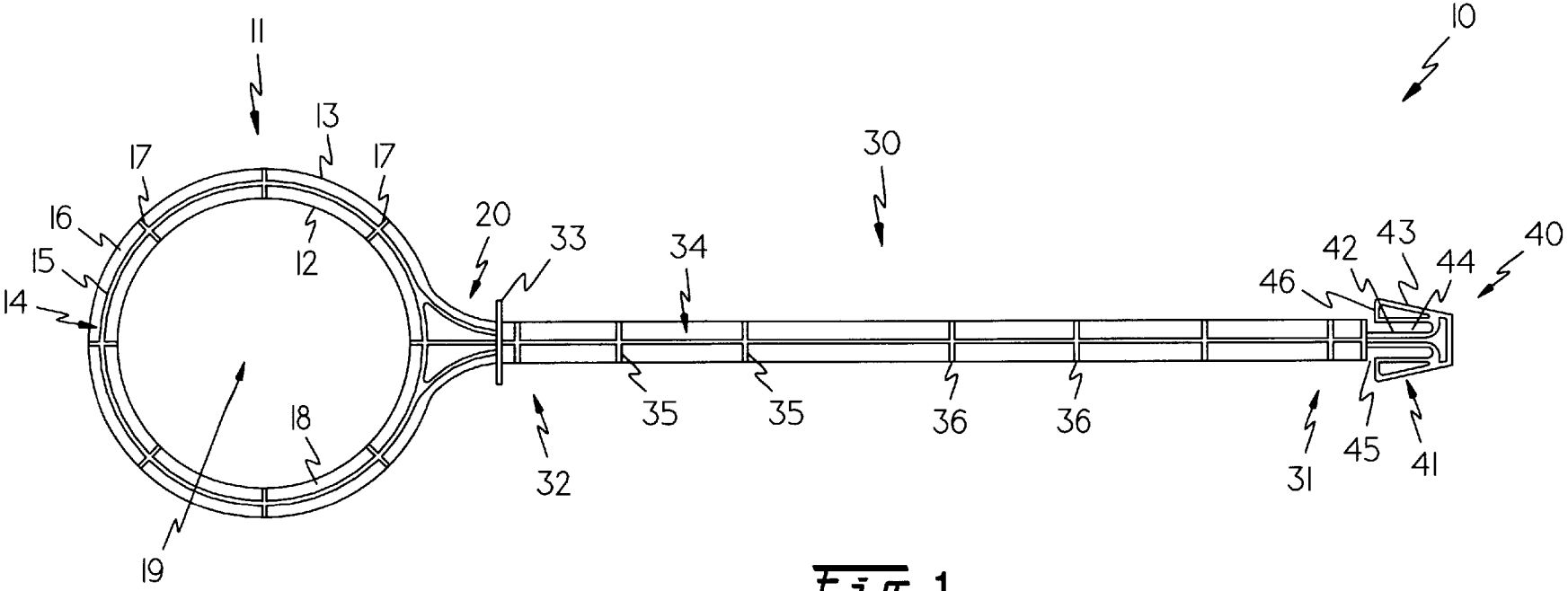
FIG. 1 is a top plan view of the preferred embodiment of the invention.
Figure 2:
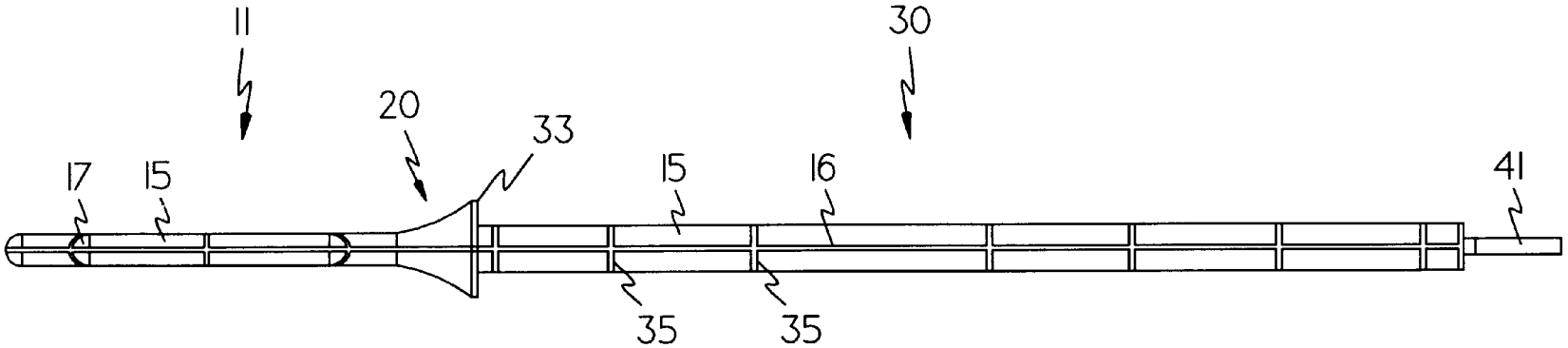
FIG. 2 is a side plan view of the preferred embodiment of the invention.

Referring to the FIG. 1, the preferred embodiment of the utility holder of the invention can be seen generally designated as 10. Utility holder 10 includes a rigid annular support member 11 with an inner circumference 12 and an outer circumference 13. The annular support member 11 includes a cruciate ribbing 14 with a vertical arm 15 and a horizontal arm 16, interspersed with strengthening disks 17 at regular intervals. It can thus be seen that the inner portion of the horizontal arm 16 of the cruciate ribbing 14 forms a shelf surface 18 in the same plane as the annular support member 11, and the area within the annular support member 11 forms a container recess 19.

Attached to the annular support member 11 is a rung insert member 30, with a first end 31, and a second end 32. The attachment between the rung insert member 30 and the annular support member 11 is by means of a smoothly curved, Y-shaped junction 20 which secures to the annular support member 11 along its outer circumference 13, and to the rung insert member 30 at its second end 32. The second end 32 of the rung insert member 30 includes a flange 33. The rung insert member 30, like the annular support member 11, is formed of cruciate ribbing 34 interspersed by strengthening disks 35. The strengthening disks 35 are all of the same diameter, so that their outer edges form a cylindrical plane which enables the rung insert member 30 to roll or rotate easily.

At the first end 31 of the rung insert member 30 is a locking unit generally designated as 40. The locking unit 40, which can best be understood by referring to FIGS. 1 and 3, comprises a pair of opposed flexible locking tabs 41 angularly attached to an extension 42 which protrudes from the first end 31. The interior end of each locking tab 41 acts as a locking surface 46. A gap 44 between the extension 42 and each locking tab 41 allows the tabs 41 to be pressed toward the center axis of the extension 42. It should thus be apparent that, when the tabs 41 are in a closed or pressed position, angled out from the extension 42 they lie entirely within the circular plane defined by the outer edges of the strengthening disks 35. When pressure is released and the tabs 41 are in the open or normal position, they will extend outside of this circular plane. The tabs 41 are shorter than the extension 42 so they do not extend completely to the first end 31 of the rung insert member 31, resulting is a space between them, generally designated as 45.

The preferred choice of materials for the utility holder of the present invention is molded plastic with fiberglass, for example a mixture of 30% glass polypropolene. This material has several advantages, including strength, lightness, and ease of manufacturing. This material is also advantageous for being fairly "slippery," thereby facilitating rotation when the invention is inserted into a rung, as will be discussed further below. It should be noted, however, that the invention could be constructed of other materials, and the disclosure of molded plastic as the material of preference is for illustrative purposes only. The only limitation on the choice of materials for the invention, aside from strength, would appear to be the need for flexibility in the locking tabs 41.

Figure 3:
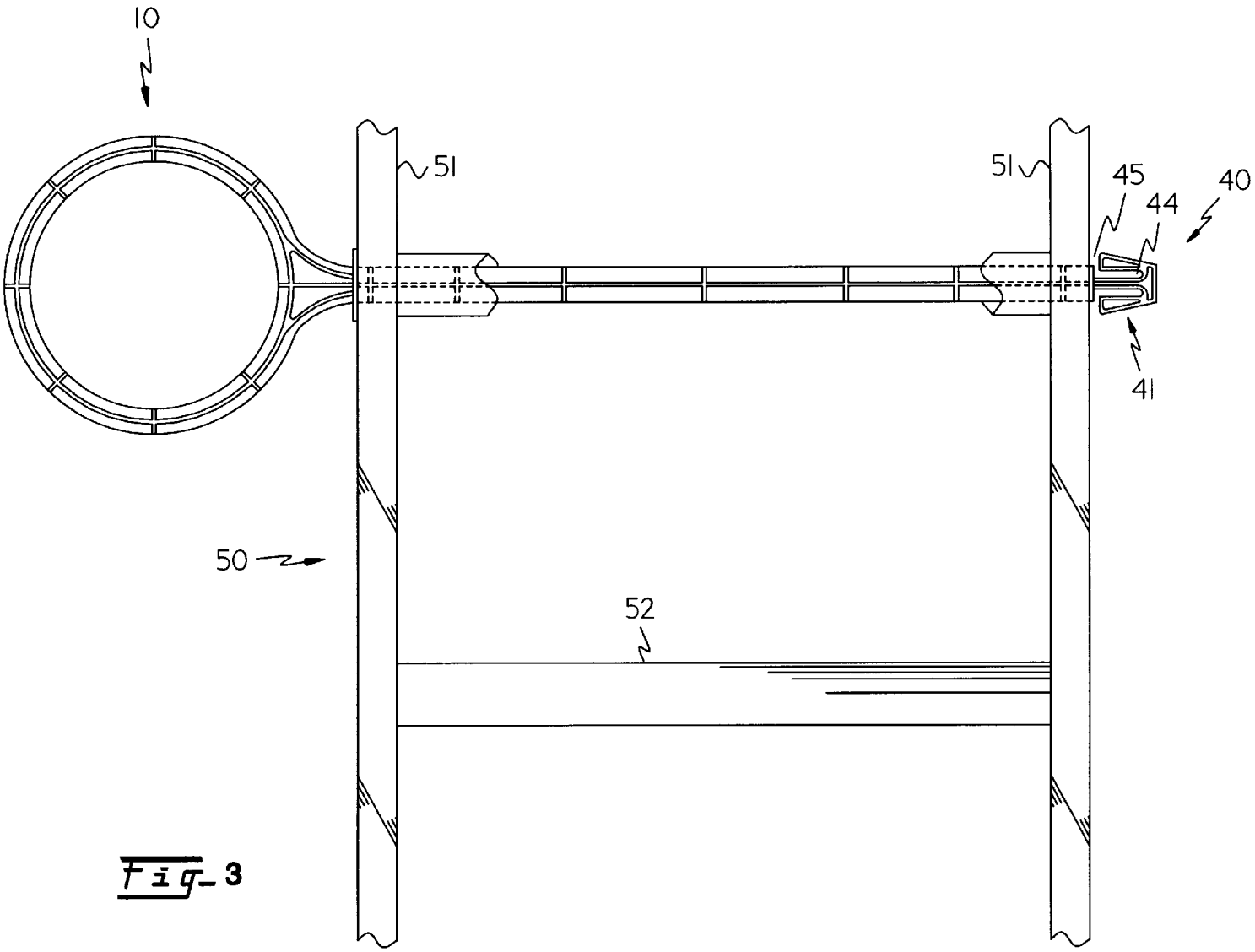
FIG. 3 is a plan view showing the invention installed in a ladder and in the locked position, with the rung of the ladder cut away for clarity.
Figure 4:
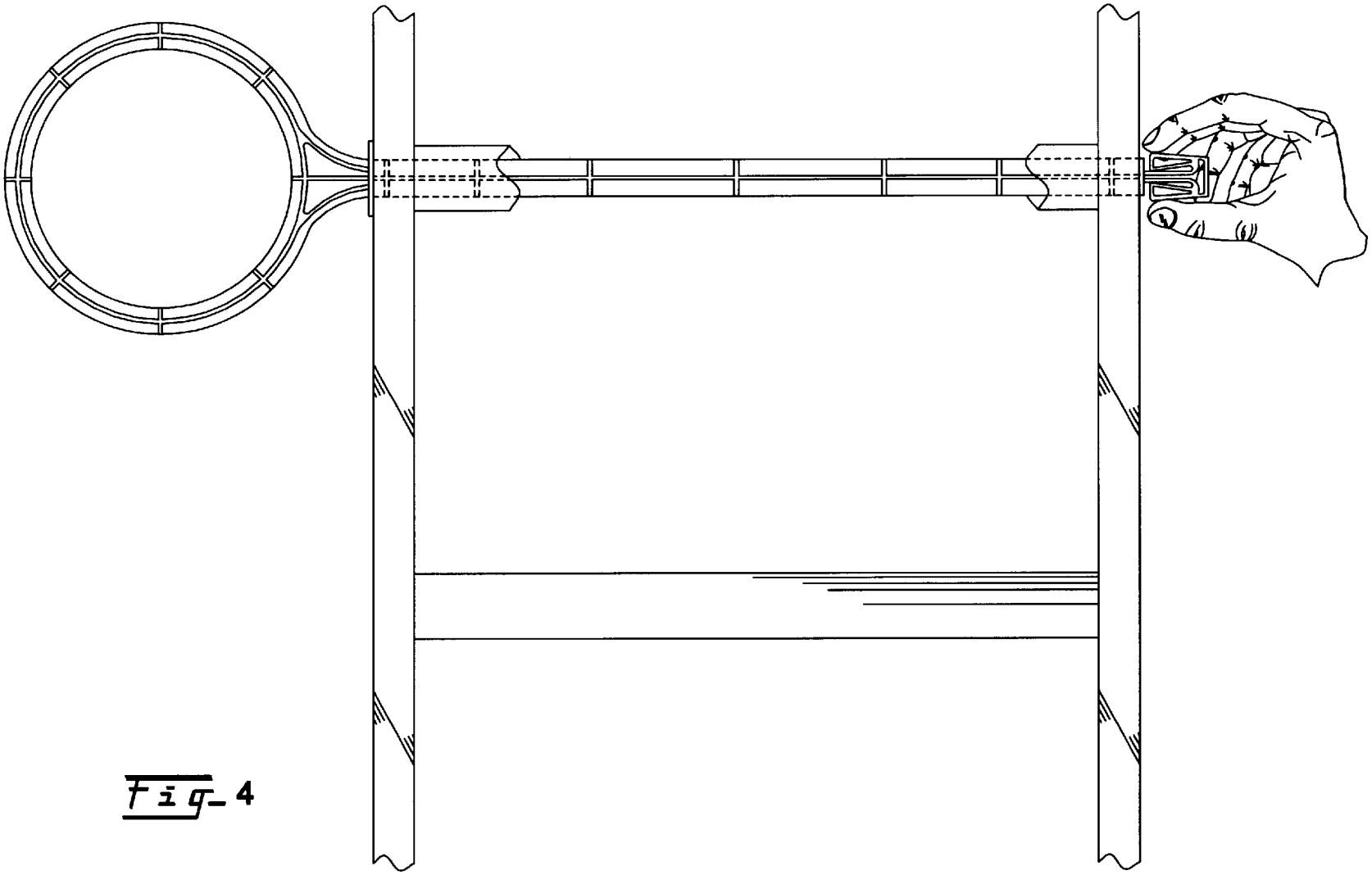
FIG. 4 is similar to FIG. 3 and shows a user's hand depressing the flexible locking tabs in preparation for removing the invention.
Figure 5:
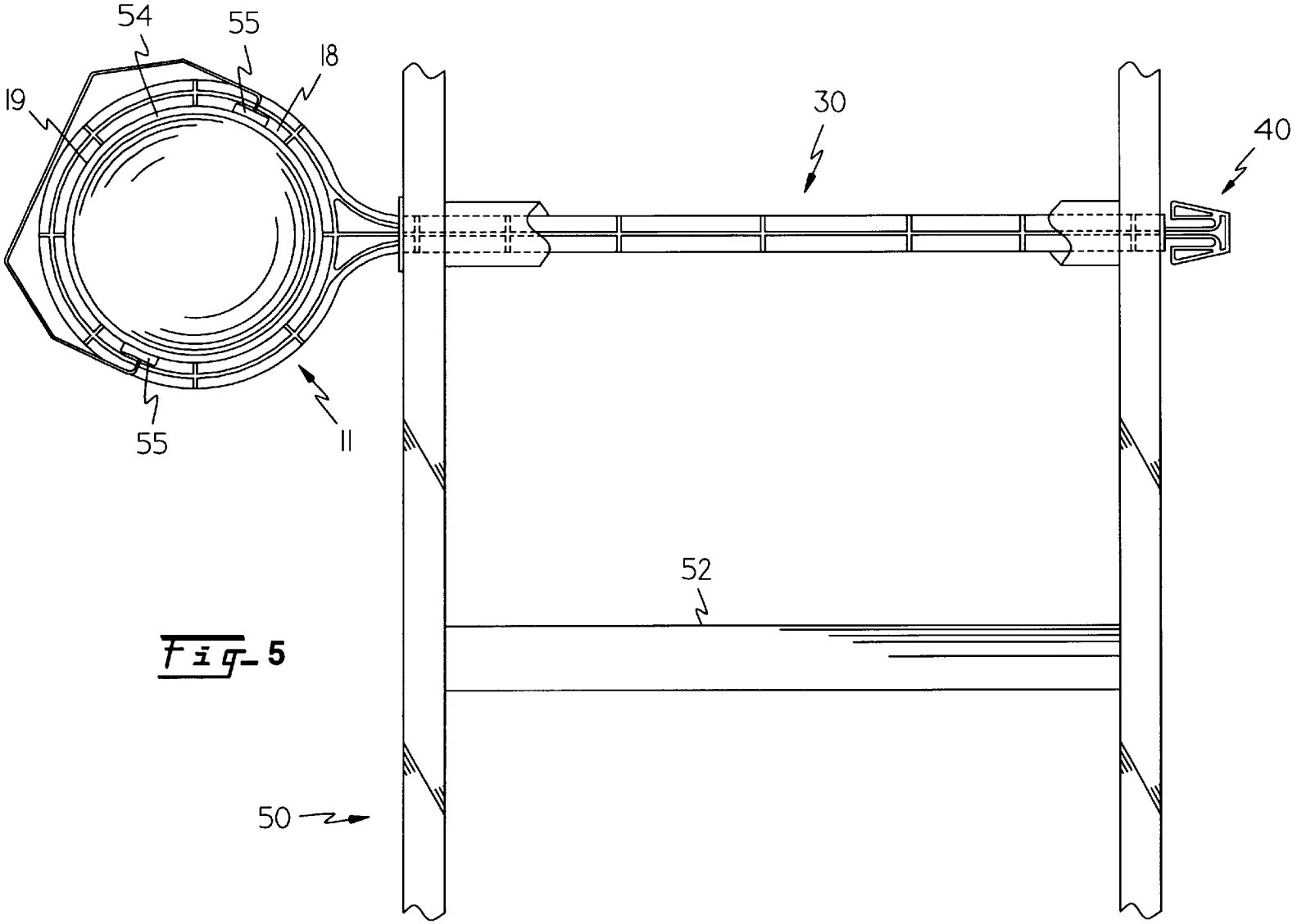
FIG. 5 is similar to FIG. 3 and shows a paint can being held by the invention.
Figure 6:
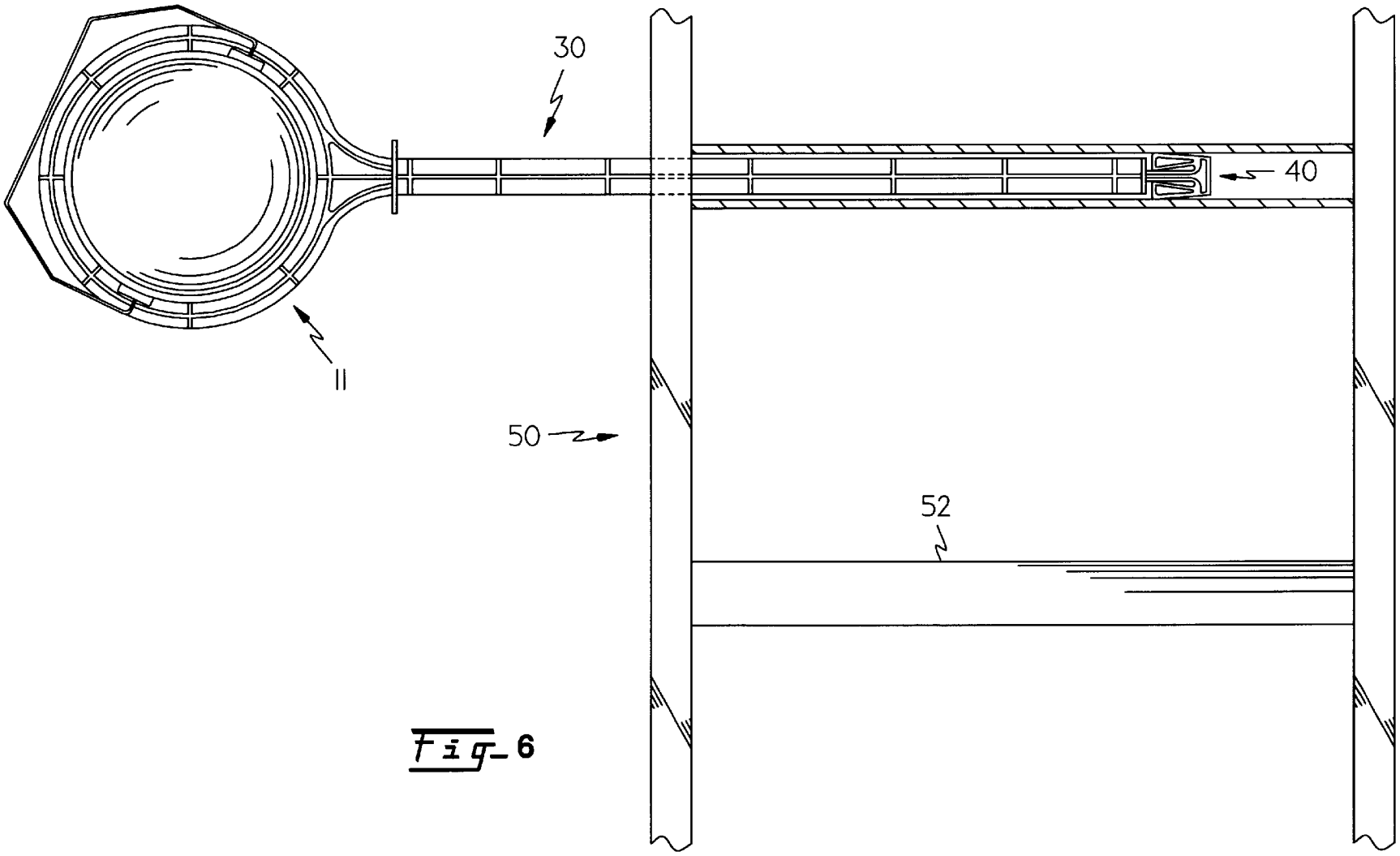
FIG. 6 is similar to FIG. 5 and shows the invention in the process of being installed or removed.

Now that the structure of the invention has been described, reference is made to FIGS. 3 and 4 which show a typical use of the invention. A hollow rung ladder 50, only a portion of which is shown in the drawings, includes two rails 51 joined at regularly spaced intervals by hollow rungs 52, the interiors of which form rung openings 53, see FIG.

7. The rung openings 53 are generally circular in shape, although in many cases the tops of the hollow rungs 52 are flattened to provide better footing for the user, resulting in a partial flattening of the rung openings 53. The present invention works satisfactorily whether the rung opening 53 is perfectly circular or flattened. The invention is used by first depressing the two flexible locking tabs 41 together, and inserting the locking unit 40 and then the rung insert member 30 into a rung opening 53. The device is pushed completely through the rung opening 53 until the locking unit 40 emerges from the opposite end of the hollow rung 52, which allows the locking tabs 41 to spring into the open position. In the open position, the locking tabs 41 are spaced farther apart than the diameter of the rung openings 53, and the locking surfaces 46 thereby prevent the device from being withdrawn from the rung opening 53 until the locking tabs 41 are again pressed together into the closed position. At the same time, the flange 33 on the first end 31 of the rung insert member 30 acts as a stop to prevent lateral movement of the device in the other direction.

Figure 7:
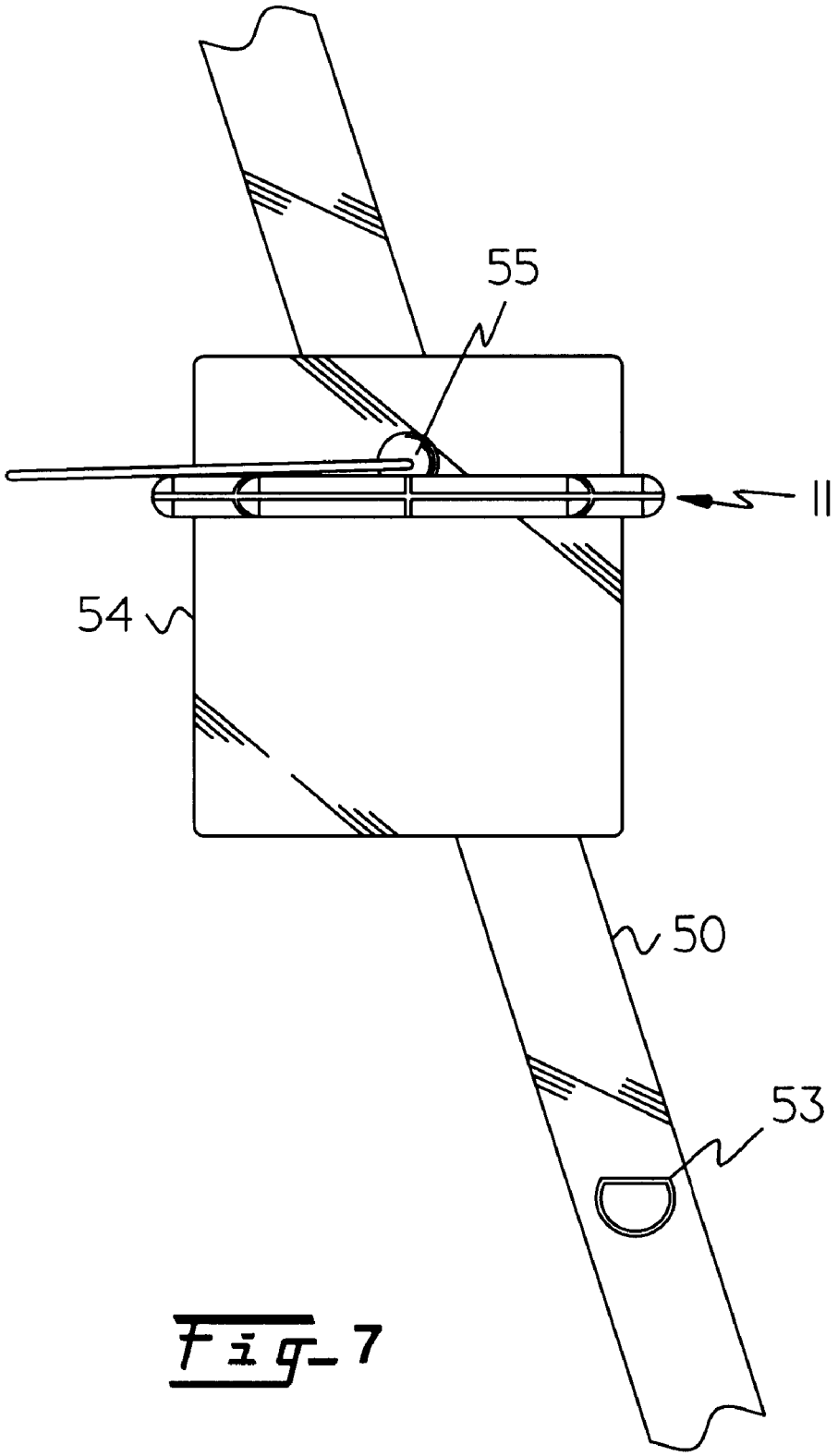
FIG. 7 is a side elevational view of a ladder with the invention in place and holding a paint can.
Figure 8:
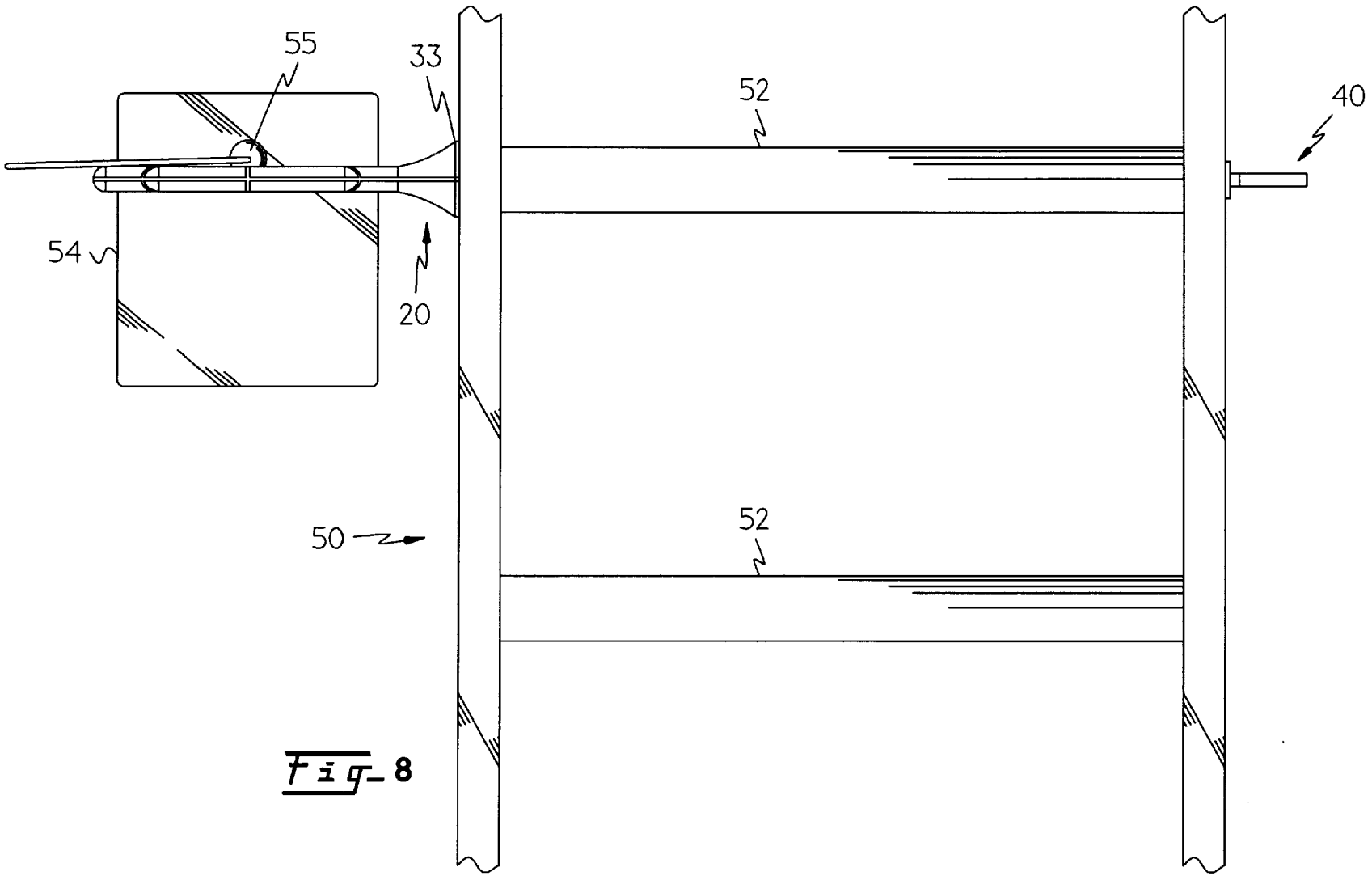
FIG. 8 is a front view of a ladder with the invention in place and holding a paint can.

When the device has been installed into a hollow rung ladder 50, it can thus be seen that the annular support member 11 can be rotated to a horizontal position, generally parallel with the ground, regardless of the angle at which the ladder is leaning. Reference is now made to FIGS. 7 and 8 to show the invention as in use. When a typical one-gallon paint can 54, with a pair of projecting handle knobs 55 spaced 180° apart on the outside circumference of the paint can 54, is inserted into the container recess 19, the handle knobs 55 rest on the top of the vertical arm 15 of the cruciate ribbing 14 which makes up the annular support member 11, thereby supporting the paint can 54 in a handy position adjacent to the ladder 50. Because most of the paint can 54 is below the plane of the annular support member 11, the center of gravity of the paint can 54 will also be below the plane of the annular support member 11, which will result in a stable position for the paint can 54 which automatically self-levels because of the rotatability of the rung insert member 30 described previously.

While working on the development of the invention, applicant has acquired information found to be very useful in making the preferred embodiment of the invention. The information is offered here only for its usefulness, and not by way of any limitation as to the invention. All standard one gallon paint cans, at least in the United States market, appear to be 6.75 inches in diameter. The diameter of the container recess 19 should thus correspond to this figure fairly closely, so that a paint can 54 will fit into the recess 19 snugly while allowing the handle knobs 55 of the paint can 54 to rest on the top of the vertical arm 15. In an alternative embodiment, the horizontal arm 16 is made sufficiently wide so that the handle knobs 55 will rest on the shelf surface 18 of the inner part of the horizontal arm 16, rather than the top of the vertical arm 15. Applicant has also determined that the majority of hollow-rung ladders on the market are approximately 16 inches wide from the outside of one rail 51 to the outside of the opposing rail 51. Thus, the distance from the inside of the flange 33 to the locking surface 46 of the flexible locking tabs 41 should be slightly over 16 inches. This will allow the device to be inserted into a hollow rung 52 and snugly locked into place. A shorter distance would not allow the device to become locked into place, while a longer one would lead to excessive lateral play in the device while it is in a locked position. Applicant has also determined that strengthening disks 35 of 1-inch diameter for the rung insert member 30, resulting in a 1-inch circular plane along the outer edges of the strengthening disks 35 also works well since most hollow-rung ladders 50 have a rung opening 53 of 1 inch or a little more in diameter. A spacing of approximately 1.5 inches between the outermost edges of the locking surfaces 46 of the locking tabs 41 when they are in the open position also has been found to work well. As indicated above, all this information is being given for informational purposes, and not for purposes of any restriction on the scope of the invention, which can be readily adapted for use with cans of different diameter, and ladders of different widths and rung opening diameters.

It should also be easily apparent that the invention is not limited to use as a holder for the standard 1 gallon paint can. For instance, in another embodiment, the annular support member 11 can be adapted to include protrusions to receive hooks from a canvas bucket or some similar container which can then hang through container recess 19 of the invention, functioning as a holder for tools or other supplies. The device will also accept containers with a continuous protruding lip, such as, for example, a pail, with the lip resting on the top of the vertical arm 15. In another embodiment, the annular support member 11 can be modified by removing one quadrant of all the strengthening disks 17 in the annular support member 11, that being the quadrant between the inner horizontal arm 16 and the upper vertical arm 15. This will result in an uninterrupted shelf surface 18 which would be suitable for holding containers with continuous protruding lips rather than handle knobs 55. Also, the rung insert member 30 could be made as a hollow tube instead of using a ribbed design without changing the essence of the invention.

I claim:

1. A utility can holder for use with hollow rung ladders, wherein the can or container to be held is secured on either side of the ladder in a convenient position for users, said holder comprising:

(a) an annular support member comprising cruciate ribbing with a vertical arm defining a circumference intersected by a horizontal arm thereby defining a container recess into which the can or container to be held can be inserted;

(b) means for engaging the can or container at or near its top end as it is inserted into the container recess such that it is prevented from passing completely therethrough;

(c) a rung insert member connected at one end to the annular support member and having a circular cross-section with a diameter sufficient to allow a snug but rotable fit within the hollow rung of a ladder and of a length sufficiently adapted to pass completely through the hollow rung; and (d) locking means for preventing a fully inserted rung insert member from being subsequently withdrawn from the hollow rung until the locking means is disengaged.

2. The utility can holder of claim 1 wherein the annular support member further comprises disks intermittently spaced about its circumference.

3. The utility can holder of claim 1 wherein the means for engaging the can or container comprises the vertical arm of the cruciate ribbing of the annular support member.

4. The utility can holder of claim 1 wherein the means for engaging the can or container comprises a shelf formed by the surface of the horizontal arm which lies within the circumference of the vertical arm.

5. The utility can holder of claim 1 wherein the diameter of the container recessed defined by the annular support member is approximately 6.75 inches.

6. The utility can holder of claim 1 wherein the rung insert member comprises cruciate ribbing with the vertical arm and horizontal arm substantially intersecting at each holder's mid point, and disks intermittently spaced along the circumference.

7. The utility can holder of claim 1 further comprising a flange at the border between the annular support member and the rung insert member.

8. The utility can holder of claim 1 wherein the locking means comprises an extension from the end of the rung insert member opposite the annular support member, said extension further comprising a plurality of flexible tabs angularly attached thereto whereby when the flexible tabs are compressed from their normal position the rung insert member can be fully inserted into a hollow rung whereupon the flexible tabs return to their normal position thereby preventing withdrawal of the rung insert member until the flexible tabs are again compressed.

* * * * *